US005921259A

United States Patent [19]

Ehler

[11] Patent Number: 5,921,259

[45] Date of Patent: Jul. 13, 1999

[54] PORTABLE SHADE FOR A VEHICLE

[76] Inventor: John A. Ehler, 7908 E. McKinley St., Scottsdale, Ariz. 85257

[21] Appl. No.: 08/988,808

[22] Filed: Dec. 11, 1997

[51] Int. Cl.[6] ..... E04H 15/06

[52] U.S. Cl. ..... 135/88.14; 135/93; 135/98; 135/119

[58] Field of Search ..... 135/88.01, 88.08, 135/88.09, 88.07, 88.14, 88.16, 95, 96, 98, 99, 119, 161, 120.1, 120.3, 120.4, 16, 33.7

[56] References Cited

U.S. PATENT DOCUMENTS

| | | | |
|---|---|---|---|
| 341,734 | 5/1886 | Davies | 135/35 |
| D. 371,673 | 7/1996 | Morales | 135/33.7 |
| 706,605 | 8/1902 | Slyder . | |
| 2,756,760 | 7/1956 | Grotteria | 135/33.7 |
| 3,032,047 | 5/1962 | Wendorf | 135/35 |
| 3,255,467 | 6/1966 | Kowalski . | |
| 3,407,825 | 10/1968 | Doyle . | |
| 4,543,971 | 10/1985 | Sirota . | |
| 4,562,849 | 1/1986 | Sirota . | |
| 4,804,008 | 2/1989 | Ryder et al. | 135/35 |
| 5,150,728 | 9/1992 | Stark . | |
| 5,529,368 | 6/1996 | Cui et al. . | |

*Primary Examiner*—Lanna Mai
*Assistant Examiner*—C. Min Choe
*Attorney, Agent, or Firm*—Parsons & Goltry; Robert A. Parsons; Michael W. Goltry

[57] ABSTRACT

A shade assembly engagable with a vehicle of a type including a body bounding a compartment for accommodating occupants, the shade assembly comprising a canopy, a support structure coupled with the canopy, a support member operably coupled with the support structure for moving the support structure from a first position to a second position for moving the canopy from a closed position to an open position, and an engagement mechanism for detachably engaging the support member with the body of the vehicle, the canopy to extend outwardly from the support member in the open position to substantially shade the compartment of the vehicle exteriorly of the compartment.

15 Claims, 5 Drawing Sheets

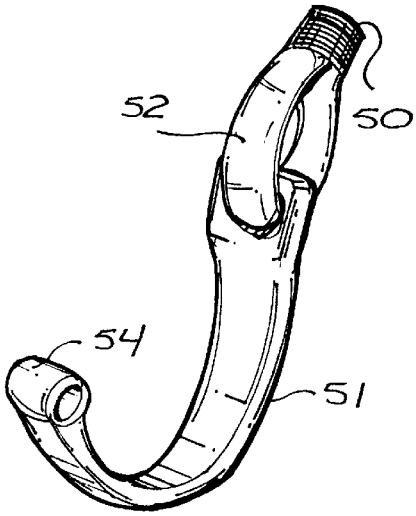
FIG. 5
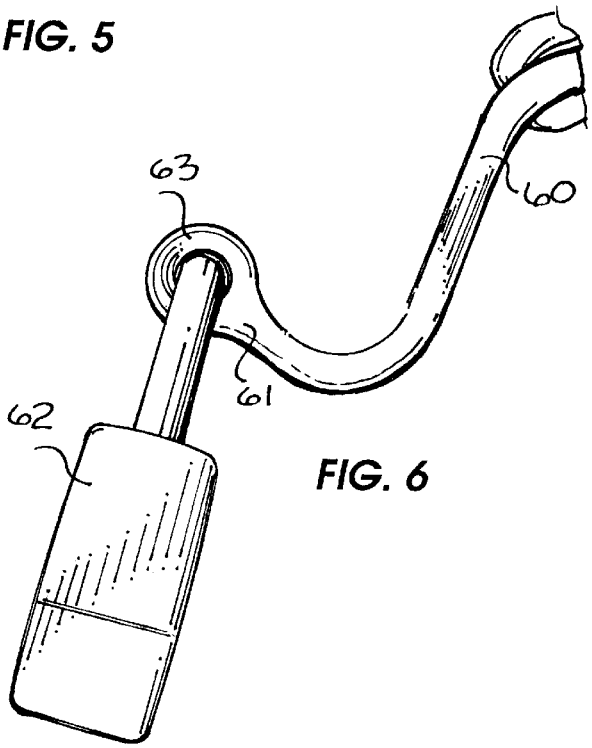
FIG. 6
FIG. 7
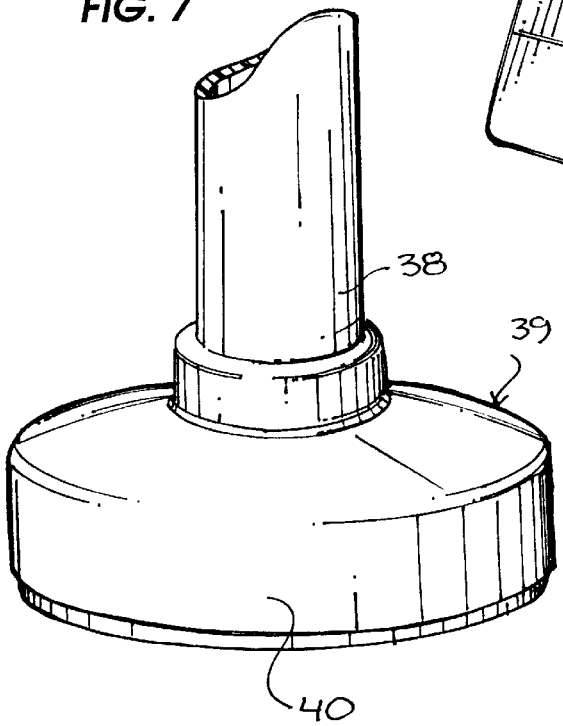
FIG. 8
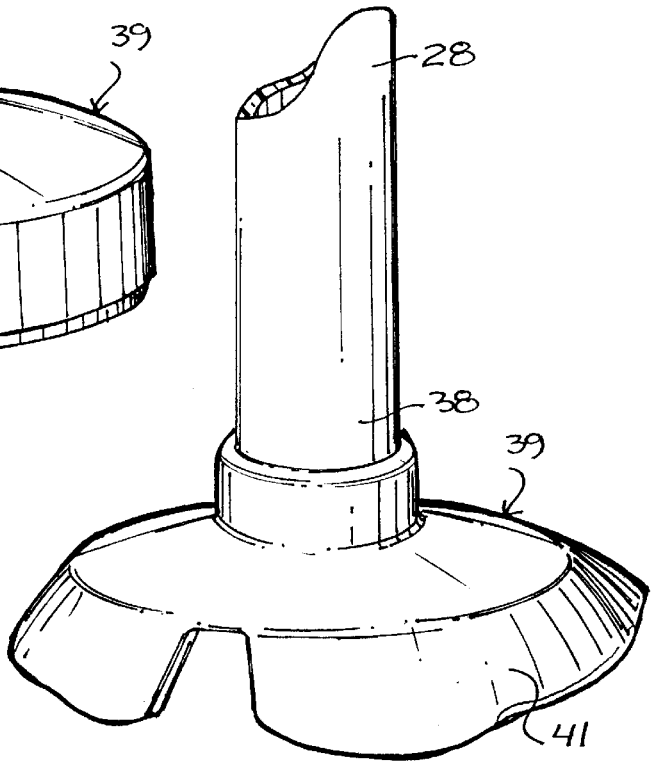

PORTABLE SHADE FOR A VEHICLE

BACKGROUND OF THE INVENTION

1. Field of the Invention

This invention relates generally to the field of shades.

More particularly, this invention relates to a shade assembly engagable with a vehicle of a type including a body bounding a compartment for accommodating occupants, the shade operative for substantially shading the compartment.

2. Prior Art

Vehicles comprise one of the most essential means of transportation. From commuting to work, traveling, shopping for groceries and running errands, vehicles, such as cars, vans and sport utility vehicles, play an indispensable part of modern life.

Because most people use their vehicles on a daily basis, it is normal for people to park their cars outside for at least part of the day, whereas during the evening hours and throughout the night, most cars may be found either in garages or carports. Without the protection of covered parking, vehicles left outside are exposed to the Sun which can not only cause the temperature within the vehicle to rise to intense levels when parked in the Sun making it uncomfortable for users to enter the vehicle, but also cause damage to exterior and interior surfaces of the vehicle directly exposed to the Sun.

To prevent passenger compartments from becoming hot when exposed to the Sun, shades are available that may be unfolded and temporarily mounted within the interior of the passenger compartment against, for instance, the front windshield, the shade being operative to inhibit The Sun's rays from shining through the front windshield. Although somewhat effective, these shades are largely insufficient because they fail to protect the entire passenger compartment from the Sun's rays. Furthermore, because the Sun's rays directly impact the windshield, the temperature within the interior compartment still heats up to exceeding high temperatures notwithstanding interior shades.

It would be highly advantageous, therefore, to remedy the foregoing and other deficiencies inherent in the prior art.

Accordingly, it is an object of the present invention to provide a shade assembly engagable with a vehicle of a type including a body bounding a compartment for accommodating occupants, the shade operative to substantially shade the compartment from a location exterior of the compartment.

Another object of the present invention is to provide a shade assembly that is easy to install.

And another object of the present invention is to provide a shade assembly that is easy to assembly.

Still another object of the present invention is to provide a shade assembly that is inexpensive.

Yet another object of the instant invention is to provide a shade assembly that prevents the Sun's rays from directly impacting a compartment of a vehicle for controlling the temperature of the interior of the compartment.

Yet still another object of the instant invention is to provide a shade assembly that inhibits damage to surfaces located within a compartment of a vehicle.

And a further object of the invention is to provide a shade assembly that is portable.

Still a further object of the immediate invention is to provide a shade assembly that is easy to transport.

Yet a further object of the invention is to provide a shade assembly that is efficient.

And still a further object of the invention is to provide a shade assembly that is inexpensive and easy to manufacture.

SUMMARY OF THE INVENTION

Briefly, to achieve the desired objects of the instant invention in accordance with a preferred embodiment thereof, provided is shade assembly engagable with a vehicle of a type including a body bounding a compartment for accommodating occupants. Like most vehicles of the type herein disclosed in combination with the present invention, the body of the vehicle may include a window movable from an open position to a closed position for substantially occluding an opening bound by a rim, the window having an edge to engage portions of the rim bounding the opening in the closed position in accordance with conventional practice.

Regarding a preferred embodiment of the present invention, the shade assembly is generally comprised of a canopy, a support structure coupled with the canopy and a support member operably coupled with the support structure for moving the support structure from a first position to a second position for moving the canopy from a closed position to an open position. The present invention may further include means for detachably engaging the support member with portions of the body of the vehicle bounding the compartment, the canopy to radiate outwardly from the support member in the open position to substantially shade the compartment of the vehicle.

To secure the canopy with the vehicle, the present invention may further include a plurality of tethers mounted with the canopy in spaced and substantially opposing relation, each one of the plurality of tethers having an engagement element detachably engagable with the vehicle at opposing ends of the vehicle. Although not an essential feature, the engagement element may be carried by a free end of each one of the plurality of tethers. In a particular embodiment, each engagement element may be provided as a hook member.

Because it may be desirable to lock the shade assembly with the vehicle for inhibiting theft, the present invention may further include a means for locking the shade assembly with the vehicle to inhibit theft of the shade assembly. In a preferred embodiment, the means for locking the shade assembly with the vehicle may include at least one locking assembly, the locking assembly being generally comprised of a locking tether coupled with the shade assembly, a brace securable between the edge of the window and portions of the rim in the closed position of the window, and means for locking the locking tether with the brace. The means for locking the locking tether with the brace may include an engagement element carried by the brace, and a complemental engagement assembly operative to lockingly engage the locking tether with the engagement element carried by the brace. Regarding a specific example, the engagement element may be comprised of a hinged member carried by the brace and having an aperture extending therethrough. The complemental engagement assembly may be comprised of a loop member carried by the locking tether, and a lock receivable by the loop member, the lock further receivable by the aperture of the member of the brace for lockingly engaging the loop member with the member carried by the brace.

In a particular embodiment, the means for detachably engaging the support member with portions of the body of the vehicle bounding the compartment may further include a magnetic fastening element carried by the support member, such as by a free end thereof, operative to magnetically couple with a metal surface of the body of the vehicle. In addition, the canopy may further include a plurality of vents for allowing air to pass to inhibit the canopy from canting in a strong wind.

BRIEF DESCRIPTION OF THE DRAWINGS

The foregoing and further and more specific objects and advantages of the present invention will become readily apparent to those skilled in the art from the following detailed description thereof taken in conjunction with the drawings in which:

FIG. 5 illustrates an engagement element of one of the plurality of tethers of FIG. 2;

FIG. 6 illustrates an end of one of the plurality of tethers first shown in FIG. 2, the tether having a loop engaged with a pad lock;

FIG. 7 illustrates an end of the support member of FIG. 1 having a magnetic fastening element operative for magnetically and detachably engaging a metal surface of a vehicle;

FIG. 8 illustrates an end of the support member of FIG. 1 having a suction cup element operative to engage the support member with a vehicle.

DETAILED DESCRIPTION OF THE PREFERRED EMBODIMENT

The present invention provides, among other things, a shade assembly for a vehicle. In a more particular aspect, the shade assembly of the present invention is engagable with a vehicle for shading a passenger compartment bound by a body of the vehicle from direct exposure to the Sun's harmful rays to protect external surfaces, such as painted surfaces, and surfaces located within the passenger compartment from damage that may otherwise result from direct exposure to the Sun's rays, and for controlling the temperature within the passenger compartment.

Figure 1:
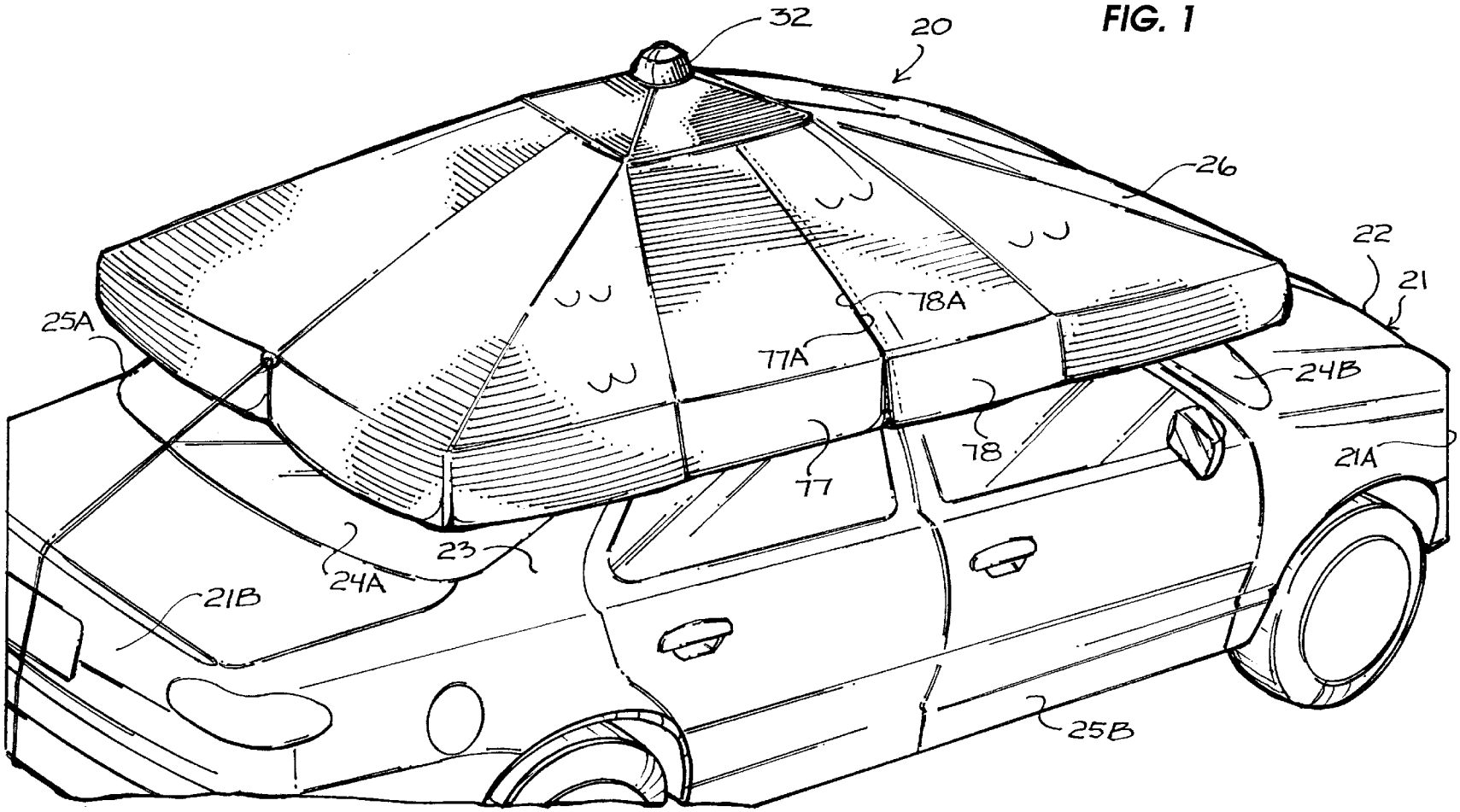
FIG. 1 illustrates a perspective view of a shade assembly engagable with a vehicle of a type including a body bounding a compartment for accommodating occupants, in accordance with a preferred embodiment of the present invention.

Turning now to the drawings, in which like reference characters indicate corresponding elements throughout the several views, attention is first directed to FIG. 1 which illustrates a perspective view of a shade assembly 20 shown as it would appear in use with a vehicle 21 of a type including a body 22 defining or otherwise bounding a cab or compartment 23 for accommodating occupants, in accordance with a preferred embodiment of the present invention. Vehicle 21 is generally considered to have a front end 21A and a rear end 21B, and compartment 23 is generally considered to have a rearward end 24A directed toward rear end 21B, a forward end 24B directed toward front end 21A, and opposing side extremities 25A and 25B.

Figure 2:
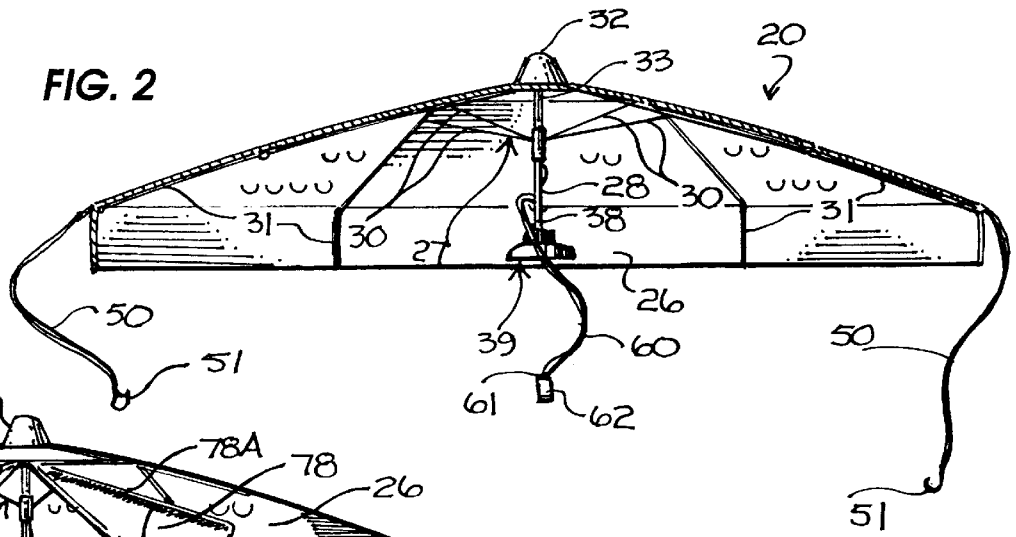
FIG. 2 illustrates a vertical sectional view of the shade assembly of FIG. 1, the shade assembly including a canopy coupled with a support structure carried by a support member, and a plurality of tethers mounted to secure the shade assembly with the vehicle.

With attention directed to FIG. 2 illustrating a vertical sectional view of shade assembly 20, shade assembly 20 is generally comprised of a canopy 26 coupled with a support structure 27 coupled in supported relation with a shaft or support member 28. Support structure 27 is generally comprised of central member 29 mounted with support member 28 and a plurality of support ribs 30 extending outwardly therefrom. Support ribs 30 couple with supporting ribs 31 mounted with canopy 26, supporting ribs 31 operative to support canopy 26 in a supported relation, all of which is carried out in a conventional manner. As shown in FIG. 1, canopy 26 radiates or otherwise extends outwardly from a central member or cap 32 in the open position, cap 32 being supported by an end 33 of support member 28 as seen in FIG. 2.

Figure 4:
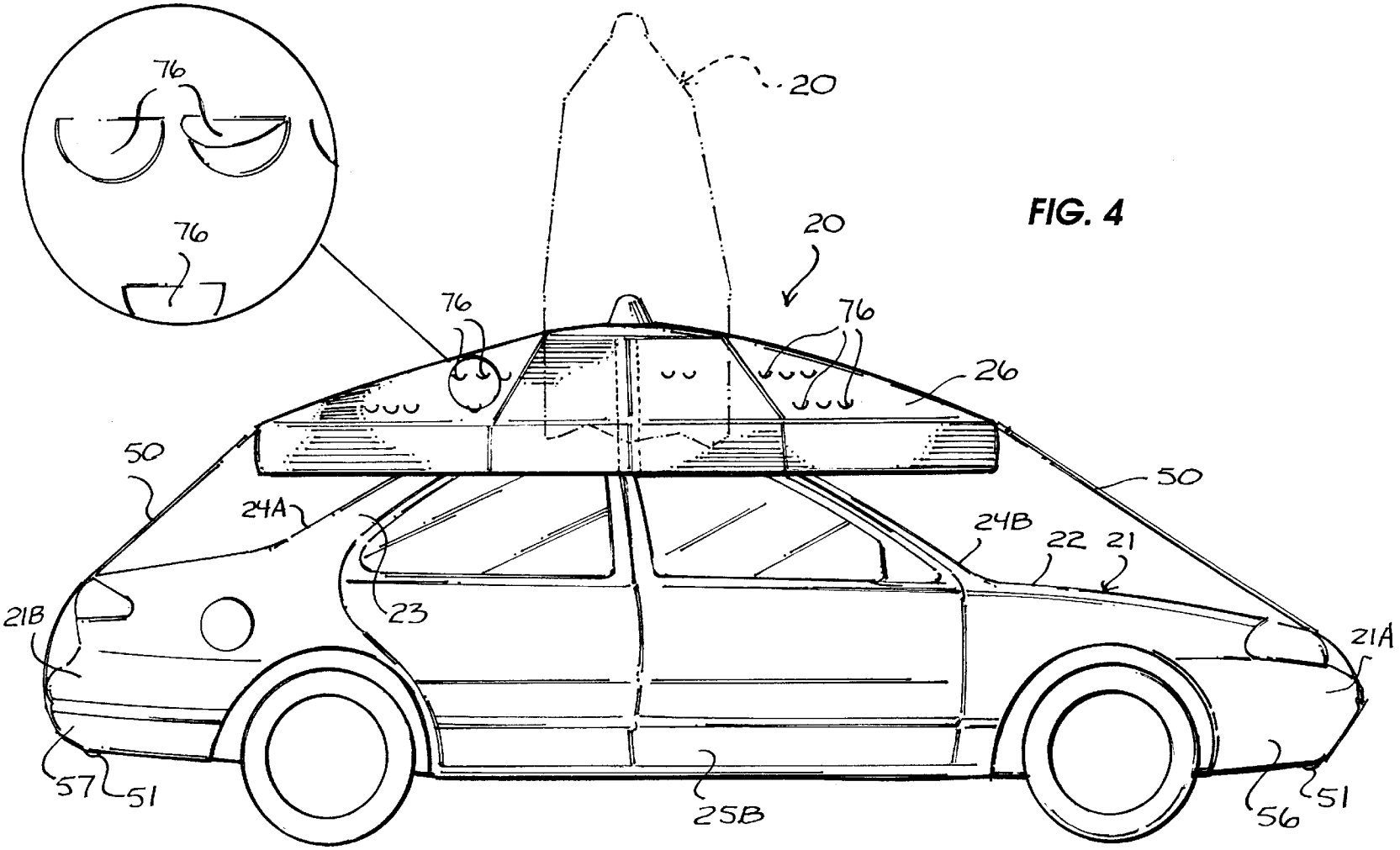
FIG. 4 illustrates a side elevational view of the shade assembly and the vehicle of FIG. 1 in addition to an enlargement of a portion of a canopy of the shade assembly showing a plurality of vents formed therethrough.

The specific construction of shade assembly 20 as herein presently set forth is not critical to the present invention provided that it is preferably collapsible between an open position set forth in FIGS. 1 and 2 to a closed position set forth in the dotted outline of shade assembly 20 in FIG. 4. To this end, and in accordance with conventional practice, support member 28 is operably coupled with support structure 27 for moving support structure 27 from a first position to a second position for moving canopy 26 from the closed position of FIG. 4 to the open position of FIG. 1 and FIG. 2, canopy 26 being preferably constructed of canvas, nylon, or other substantially pliant material. The preferred collapsible nature of shade assembly 20 allows for portability that contributes to easy storage and transport. However, canopy 26 is constructed of a size such that when shade assembly 20 is properly installed, will substantially shade compartment 23 exteriorly and substantially superjacent thereof from rearward end 24A to forward end 24B, and from side extremity 25A to side extremity 25B, thus operative to protect compartment 23 substantially from direct exposure to the Sun's rays.

In accordance with a preferred embodiment, support member 28 includes a free end 38 having an engagement mechanism 39 operative to detachably engage vehicle 21. Because the bodies of most conventional vehicles are constructed of metal, engagement mechanism 39, best shown in FIG. 7, may be provided as a magnetic fastening element 40 operative to magnetically and detachably engage a metal surface of body 22 of vehicle 21. However, in an alternate embodiment, engagement mechanism 39 may be provided as a suction cup 41 set forth in FIG. 8 operative to engage, by suction, a surface of body 22 of vehicle 21.

Figure 3:
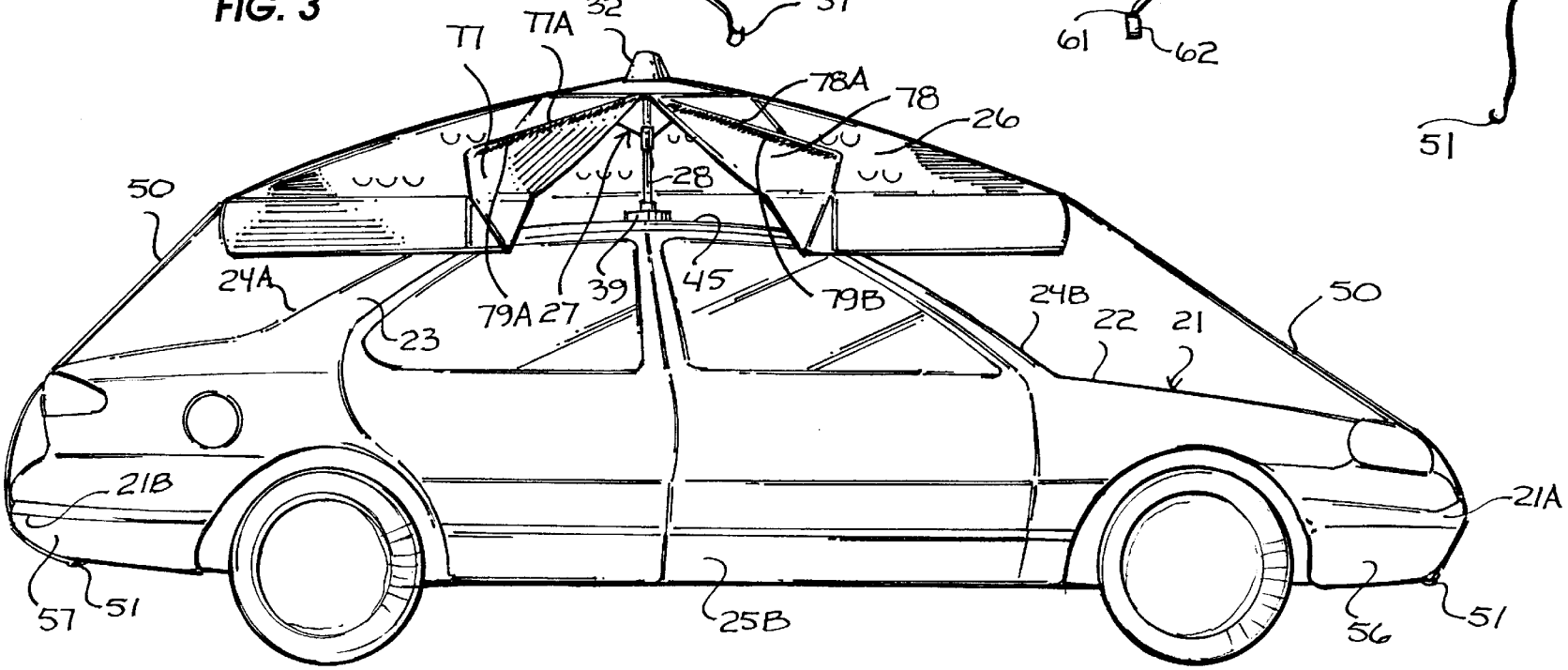
FIG. 3 illustrates a side elevational view of the shade assembly and the vehicle of FIG. 1.

With attention directed to FIG. 3 illustrating a side elevational view of shade assembly 20 and vehicle 21 of FIG. 1, engagement mechanism 39 of shade assembly 20 is generally intended to be engaged with roof 45 of compartment 23 of vehicle 21 in a preferred manner of installation, such that in the open position, canopy 26 will extend outwardly to substantially shade compartment 23 as shown and previously discussed. However, this is not an essential feature in that canopy 26 may be mounted with support member 28 in other conventional manners such that with support member 28 mounted with vehicle 21 at other locations along vehicle 21 from front end 21A to rear end 21B, canopy may extend outwardly in the open position to substantially shade compartment 23 in accordance with the desired teachings herein.

Upon installation of shade assembly 20 with vehicle 21 as set forth in FIG. 3, the present invention further provides an assembly operative to secure canopy 26 with vehicle 21. To secure canopy 26 with vehicle 21, shade assembly 20 further includes a plurality of tethers 50 coupled with and extending outwardly from opposing ends of canopy 26, each tether 50 terminating with a hook member 51 (best shown in FIG. 2) operative as an engagement element to detachably engage vehicle 21 at front end 21A and rear end 21B, respectively. Regarding a preferred embodiment, each tether 50 is preferably constructed of a substantially elastic material to allow sufficient stretching for a user to easily engage hook member 51 with vehicle 21 while allowing each tether 50 to securely hold canopy 26 in place. However, this is not an essential feature and each tether 50 may otherwise be provided as a rope, a metal cable, a chain, etc.

With momentary attention directed to FIG. 5, each tether 50 terminates with a free end 52 in the form of a loop, with each hook member 51 having a proximal end 53 mounted with the loop generally defining free end 52. Preferably constructed of plastic, a selected metal or other similar substance, each hook member 51 terminates with an enlarged free end 54. Referring back to FIG. 3, it is generally intended for each hook member 51 to engage a front and rear bumper 56 and 57, respectively, of vehicle 21 at the opposing front and rear ends 21A and 21B, with the enlarged free end 54 of each hook member 51 operating to prevent each hook member 51 from slipping or otherwise disengaging from vehicle 21 after so engaged.

With attention directed back to FIG. 2, shade assembly 20 further includes a locking tether 60, of like construction to each tether 50, coupled with support member 28 and terminating with, as best seen in FIG. 6, a free 61. Although locking tether 60 is disclosed as coupled with support member 28 in a preferred embodiment, this is not essential and locking tether 60 may be coupled at other locations if desired such as with canopy 26 or perhaps support structure 27. Free end 61 is generally defined by a loop member 63 operative for receiving, in a conventional manner, a conventional pad lock 62. Locking tether 60, in combination with pad lock 62, is operative for lockingly engaging shade assembly 20 with vehicle 21 for inhibiting theft of shade assembly 20. In this regard, it is preferred that locking tether 60 be constructed of metal cable, a metal chain or other similar material that may not be easily cut.

Figure 9:
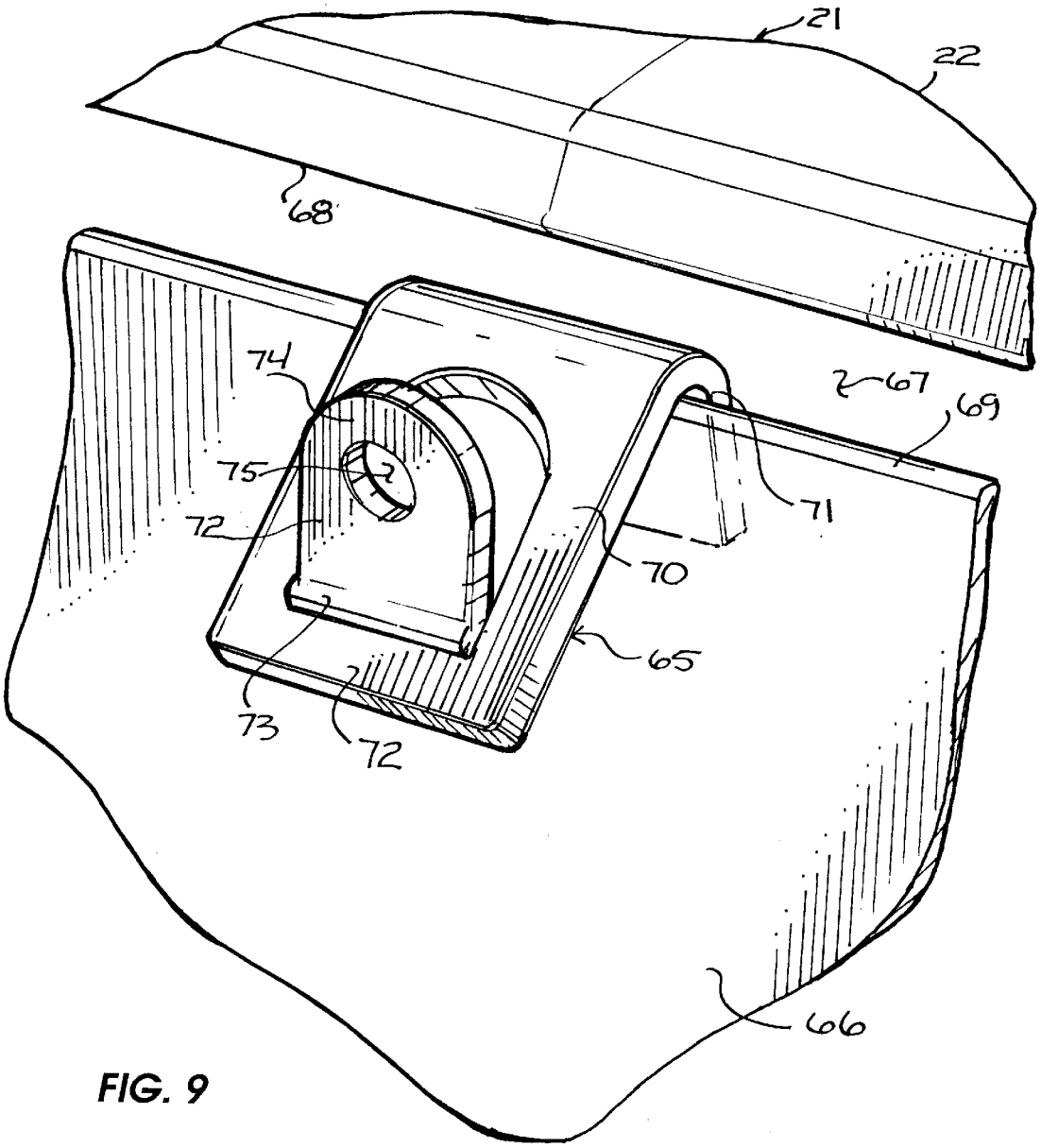
FIG. 9 illustrates a brace engagable with a selected one of the plurality of tethers of FIG. 2 and to a vehicle for securing the shade assembly with the vehicle.

To lockingly engage locking tether 60 with vehicle, and with attention directed to FIG. 9, the present invention further provides a brace 65 that may be engaged with vehicle 21 and locking tether 60. To mount brace 65 with vehicle 21, vehicle 21 must further include a window 66, such as a door window or a windbreaker window, movable from an open position to a closed position for substantially occluding an opening 67 bound by a rim 68 formed with body 22 of vehicle 21, window 66 having an edge 69 to engage portions of rim 68 bounding opening 67 in the closed position in accordance with conventional practice. Brace 65 may be secured between edge 69 of window and portions of rim 68 confronting edge 69 in the closed position of window 66.

Regarding a preferred embodiment, brace 65 is generally comprised of a body 70 having a hooked end 71 for receipt over edge 68 of window as seen in FIG. 9, and a free end 72 to extend outboard of window 68 so installed. Notwithstanding the foregoing, hooked end 71 may be engaged with rim 68 if desired. Brace 65 further includes an engagement element defined as a member 72 having an end 73 coupled with body 70 and a free end 74 having an aperture 75 extending therethrough. Although not an essential feature, end 73 is preferably hingedly coupled with body 70 to allow hinged movement of member 72.

Upon installation of brace 65 with vehicle 21 in the manner previously discussed, a user may lockingly engage free end 61 of locking tether 60 with member 72. With loop member 63 and pad lock 62 operating as an engagement assembly to lockingly engage member 72, a user may engage and lock pad lock 62 with loop member 63 of locking tether 60 and with aperture 75 of member 72 to lockingly engage locking tether 60 with brace 65. In this regard, with pad lock 62 lockingly engaging locking tether 60 with brace 65, shade assembly 20 can be locked with vehicle 21 for inhibiting theft of shade assembly 20. To unlock locking tether 60 from vehicle 21, the foregoing process may be reversed.

The present invention has been described above with reference to a preferred embodiment. However, those skilled in the art will recognize that changes and modifications may be made in the described embodiments without departing from the nature and scope of the present invention. For instance, with attention directed to FIG. 4 illustrating a side elevational view of shade assembly 20 and vehicle 21 in addition to an enlargement of a portion of canopy 26, canopy 26 may be provided with a plurality of vents 76 formed therethrough for allowing air to pass to desirably inhibit canopy 26 from canting in a brisk or strong wind. Because canopy is constructed of a size sufficiently large to shade compartment 23, canting of canopy 26 in a brisk wind would normally occur but for vents 76.

Furthermore, and with attention directed back to FIG. 3, canopy 26 may be divided, at a selected location, by a pair of opposed flaps 77 and 78 that may be spread apart in an open position as shown for allowing a user to more easily access support member 28 and support structure 27 for allowing the user to move canopy 26 alternately between the open and closed positions as required during normal use. Consistent with the foregoing, opposing edges 77A and 78A of flaps 77 and 78 may be provided with an engagement element 79A and a detachably engagable complemental engagement element 79B operative for allowing a user to detachably engage the opposing edges 77A and 78A of flaps 77 and 78 together in a closed position as shown in FIG. 1 upon proper installation of shade assembly 20. Engagement element 79A and complemental engagement element 79A may be provided as a conventional zipper assembly, a hook and loop engagement mechanism commonly found under the exemplary trademark VELCRO®, conventional snap mechanisms or other conventional engagement mechanism.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In combination with a vehicle of a type having a body bounding a compartment for accommodating occupants, a shade assembly comprising:

a canopy;

a support structure coupled with the canopy;

a support member operably coupled with the support structure for moving the support structure from a first position to a second position for moving the canopy from a closed position to an open position;

means for detachably engaging the support member with a body of a vehicle;

means for locking the shade assembly with the vehicle;

the canopy to extend outwardly from the support member in the open position to substantially shade a compartment of the vehicle exteriorly of the compartment;

the vehicle further including a window movable from an open position to a closed position for substantially occluding an opening bound by a rim, the window having an edge to engage portions of the rim bounding the opening in the closed position, wherein the means for locking includes at least one locking assembly comprising:

a locking tether coupled with the shade assembly;

a brace securable between the edge of the window and the rim in the closed position of the window; and means for locking the locking tether with the brace.

2. The shade assembly of claim 1, wherein the means for locking includes:

an engagement element carried by the brace; and a complemental engagement assembly operative to lockingly engage the locking tether with the engagement element carried by the brace.

3. The shade assembly of claim 2, wherein the engagement element includes a member with an aperture extending therethrough.

4. The shade assembly of claim 3, wherein the complemental engagement assembly includes:

a loop member carried by the locking tether; and a lock receivable by the loop member and the aperture of the member for lockingly engaging the loop member with the member.

5. The shade assembly of claim 3, wherein the member further includes an end hingedly mounted with the brace spaced from the aperture.

6. The shade assembly of claim 1, wherein the means carried by the support member for detachably engaging the support member with the body of the vehicle includes a magnetic fastening element to magnetically couple with a metal surface of the body of the vehicle.

7. The shade assembly of claim 6, the canopy further divided by a pair of opposing flaps movable between an open position to allow a user to access the support member and the support structure to allow a user to move the canopy between the open and closed positions, and a closed position.

8. A shade assembly for use with a vehicle of a type including a body bounding a compartment for accommodating occupants, the shade assembly comprising:

a canopy;

a support structure coupled with the canopy;

a support member operably coupled with the support structure for moving the support structure from a first position to a second position for moving the canopy from a closed position to an open position;

means for detachably engaging the support member with portions of the body of the vehicle bounding the compartment;

means for locking the shade assembly with the vehicle;

the canopy to radiate outwardly from the support member in the open position to substantially shade the compartment of the vehicle;

portions of the body bounding the compartment further including a window movable from an open position to a closed position for substantially occluding an opening bound by a rim, the window having an edge to engage portions of the rim bounding the opening in the closed position, wherein the means for locking includes at least one locking assembly comprising:

a locking tether coupled with the shade assembly;

a brace securable between the edge of the window and the rim in the closed position of the window; and means for locking the locking tether with the brace.

9. The shade assembly of claim 8, wherein the means for locking includes:

an engagement element carried by the brace; and a complemental engagement assembly operative to lockingly engage the locking tether with the engagement element carried by the brace.

10. The shade assembly of claim 9, wherein the engagement element includes a member carried by the brace and having an aperture extending therethrough.

11. The shade assembly of claim 10, wherein the complemental engagement assembly includes:

a loop member carried by the locking tether; and a lock receivable by the loop member and the aperture of the member carried by the brace for lockingly engaging the loop member with the member carried by the brace.

12. The shade assembly of claim 11, wherein the member carried by the brace further includes an end hingedly mounted with the brace spaced from the aperture.

13. The shade assembly of claim 8, wherein the means for detachably engaging the support member with portions of the body of the vehicle bounding the compartment further includes a magnetic fastening element carried by the support member operative to magnetically couple with a metal surface of the body of the vehicle.

14. The shade assembly of claim 8, the canopy further divided by a pair of opposing flaps movable between an open position for allowing a user to access the support member and the support structure to allow a user to move the canopy between the open and closed positions, and a closed position.

15. The shade assembly of claim 8, further including coupling means for detachably coupling the flaps together in the closed position of the flaps.

* * * * *